US005241731A

United States Patent [19]

Stuart

[11] Patent Number: 5,241,731

[45] Date of Patent: Sep. 7, 1993

[54] APPARATUS FOR COMMINGLING CONTINUOUS MULTIFILAMENT YARNS

[75] Inventor: Lambert M. Stuart, North Kingstown, R.I.

[73] Assignee: Concordia Mfg. Co., Inc., Coventry, R.I.

[21] Appl. No.: 963,435

[22] Filed: Oct. 19, 1992

Related U.S. Application Data

[60] Division of Ser. No. 670,288, Mar. 15, 1991, Pat. No. 5,182,839, which is a continuation-in-part of Ser. No. 377,175, Jul. 10, 1989, Pat. No. 5,000,807, which is a continuation of Ser. No. 21,248, Mar. 3, 1987, abandoned.

[51] Int. Cl.[5] ..... D01D 11/02; B23Q 15/00

[52] U.S. Cl. ..... 28/282; 28/219; 156/166

[58] Field of Search ..... 28/282, 283, 219; 209/127.4, 130; 361/222; 156/166, 181

[56] References Cited

U.S. PATENT DOCUMENTS

| | | | |
|---|---|---|---|
| 840,802 | 1/1907 | Pickard | 209/130 |
| 954,199 | 4/1910 | Moore | 361/222 X |
| 2,964,900 | 12/1960 | Hicks, Jr. . | |
| 3,117,888 | 1/1964 | Fox . | |
| 3,197,351 | 7/1965 | Selby . | |
| 3,328,850 | 7/1967 | Watson . | |
| 3,345,697 | 10/1967 | Aspy, Jr. . | |
| 3,358,436 | 10/1967 | Niina et al. . | |
| 3,436,797 | 4/1969 | Graf et al. . | |
| 3,593,074 | 7/1971 | Isakoff . | |
| 3,704,485 | 12/1972 | Hall . | |
| 3,739,566 | 6/1973 | Smith . | |
| 3,795,944 | 3/1974 | Daniels . | |
| 3,798,095 | 3/1974 | Hall . | |
| 3,873,389 | 3/1975 | Daniels . | |
| 4,033,492 | 7/1977 | Imai . | |
| 4,271,570 | 6/1981 | Curzio . | |
| 4,347,960 | 9/1982 | Gageur . | |
| 4,539,249 | 9/1985 | Curzio . | |
| 4,588,538 | 5/1986 | Chung et al. . | |
| 4,797,201 | 1/1989 | Küppers | 209/127.4 |
| 4,799,985 | 1/1989 | McMahon et al. . | |
| 4,818,318 | 4/1989 | McMahon et al. . | |
| 4,871,491 | 10/1989 | McMahon et al. . | |
| 4,874,563 | 1/1989 | McMahon et al. . | |
| 4,896,808 | 1/1990 | Bolza-Schünemann et al. . | |
| 5,042,122 | 8/1991 | Iyer et al. . | |
| 5,060,351 | 10/1991 | Street . | |
| 5,182,839 | 2/1992 | Stuart | 28/283 |

FOREIGN PATENT DOCUMENTS

| | | | |
|---|---|---|---|
| 27955 | 4/1964 | German Democratic Rep. | 28/282 |
| 45-05750 | 2/1970 | Japan | 28/282 |
| 46-05531 | 2/1971 | Japan | 28/282 |
| 46-16293 | 5/1971 | Japan | 28/282 |
| 47-03861 | 2/1972 | Japan | 28/282 |
| 0083842 | 2/1972 | Japan . | |
| 333873 | 11/1958 | Switzerland | 28/282 |

OTHER PUBLICATIONS

"Operating Instructions for Interlace Tester OBESTAT".

*Primary Examiner*—Clifford D. Crowder
*Assistant Examiner*—John J. Calvert
*Attorney, Agent, or Firm*—Fish & Richardson

[57] ABSTRACT

Improving commingling two or more continuous multiple filament yarns into a single yarn by rubbing one yarn against a static charge-inducing body that is supported in an electrically isolated manner to apply static charge to the yarn to tend to cause separation of its individual multiple filament. Also disclosed is commingling apparatus in which individual filaments of a multiple filament yarn are spread from each other in an enclosure that contains a source of the multiple filament yarn and has a yarn exit opening through which the filaments leave the enclosure in a separated state, a vacuum source being to connected to an air removal opening so that air flows through and around the yarn at a direction transverse to the yarn to cause spreading of the filaments, the yarn from the source passing through a guide and a weighted dancer whose movements up and down (in response to changes in tension in the yarn) control a positive feed drive for the yarn source. Also disclosed is apparatus for commingling different multiple filament yarns that includes a plurality of sources of one kind of multiple filament yarn and a plurality of tension adjustment devices for each individual yarn to reduce differences in tension among the yarns as they are presented as a flattened ribbon and combined with a flattened ribbon of a different type of yarn.

5 Claims, 7 Drawing Sheets

APPARATUS FOR COMMINGLING CONTINUOUS MULTIFILAMENT YARNS

This is a divisional of copending application Ser. No. 07/670,288 filed Mar. 15, 1991, now U.S. Pat. No. 5,182,839, which is a continuation-in-part of Ser. No. 07/377,175, filed Jul. 10, 1989, now U.S. Pat. No. 5,000,807, issued Mar. 19, 1991, which is a continuation of Ser. No. 07/021,248, filed Mar. 3, 1987, now abandoned.

FIELD OF THE INVENTION

The invention relates to commingling two or more continuous multiple filament yarns into a single yarn.

BACKGROUND OF THE INVENTION

It is sometimes desirable to commingle or hybridize two or more continuous multiple filament yarns into a single yarn to provide the combined beneficial characteristics of the two different materials in a single yarn. Such commingled yarns make possible the manufacture of advanced thermoplastic composite parts in very complex shapes. For example, commingled carbon and polyether ether ketone (PEEK) yarns are desirable, because, in a mold under heat and pressure, the PEEK melts and flows around the carbon fibers, forming a lightweight, reinforced plastic without the complications of the more traditional wet epoxy and polyester resin systems.

Curzio U.S. Pat. No. 4,539,249 discloses combining graphite fibers from one spool with thermoplastic resin fibers from other spools by passing thermoplastic and graphite fibers through a guide plate, twisting these fibers and overwrapping these fibers with additional resin fibers from additional spools to provide a blended yarn.

SUMMARY OF THE INVENTION

It has been discovered that commingling of two or more different continuous multiple filament supply yarns can be improved by rubbing a difficult-to-separate supply yarn against a static charge-inducing body that is supported in an electrically isolated manner in order to apply a static charge to the yarn to tend to cause separation of the individual filaments before combining the supply yarns.

In preferred embodiments the supply yarns are separately formed into opened ribbons in which at least some of the individual filaments are spaced from each other, and the opened ribbons are combined so as to cause interleaving and mixing of the different individual filaments; the yarn being charged travels around a plurality of motorized rollers in order to induce the static charge; the yarn being charged passes around a ribboning bar in order to spread out the charged filaments; the relative speeds of the yarns and the charge-inducing rollers are adjustable in order to vary the amount of charge applied to the yarn; a second yarn is formed into an opened ribbon using an air curtain; the two opened ribbons are combined together at a commingling bar; sizing is applied to the yarns after combining; and the yarns travel through the apparatus at greater than approximately 70 feet per minute (most preferably greater than approximately 100 feet per minute). Advantages are that the individual filaments in the commingled yarn remain parallel, the feed yarns are blended with a high degree of homogeneity, and the process is very economical.

In another aspect, the invention features, in general, spreading filaments of a multiple filament yarn in an enclosure that contains a source of the multiple filament yarn and has a yarn exit opening through which the filaments pass in a separated state, an air removal opening, and means (e.g., a vacuum source) to provide a lower pressure at the air removal opening than at the yarn exit opening. The yarn, the yarn exit opening and the air removal opening are positioned such that air flows through and around a portion of the yarn at a direction transverse to the yarn in the travel of the air from the yarn exit opening to the air removal opening, causing spreading of the filaments. In addition, the enclosure and airflow act to remove particles from the filaments and discharge them through the air removal opening, preventing them from escaping into the atmosphere.

In preferred embodiments, the yarn exit opening is elongated, and the yarn passes as a flattened ribbon through the opening and over a roller mounted in the vicinity of the opening. From the roller, the yarn passes over a surface of the enclosure that has holes in it to provide airflow through the yarn to remove additional particles that are still on the yarn or are liberated in travel over the roller. The source of yarn is located on the opposite side of the yarn exit opening from the air removal opening. The enclosure has openings near the source of yarn to remove particles liberated as the yarn leaves the source. The yarn from the source passes through a guide and a weighted dancer whose movements up and down (in response to changes in tension) provide electrical control signals to a positive feed drive for the yarn source. Limit switches are used to shut off the system if the dancer goes beyond the upper or lower limit. The yarn leaves the weighted dancer with the filaments in close proximity to each other and travels forward and upward toward the yarn exit opening, the filaments spreading out as they are intersected by air flow from the yarn exit opening to the air removal opening. The enclosure increases in cross-sectional area from the end near the yarn source to the end at the air removal opening. Position sensors are used to sense the positions of the edges of the flattened ribbon traveling from the roller and provide control signals to make adjustments to change the width of the flattened ribbon or shift it laterally. The adjustments can include adjusting the airflow at the air removal opening, moving vertical shields on both sides of the yarn exit opening (laterally or forward or backward), or moving one end of the roller with respect to the other (up/down or forward/backward).

The apparatus is preferably used to spread and remove particles from multiple filament graphite yarn that is commingled with a thermoplastic multiple filament yarn that is separated by rubbing of the thermoplastic yarn past an electrostatic body.

In another aspect, the invention features, in general, spreading filaments of a multiple filament yarn by supplying the yarn from a rotating circular support on which the yarn is supplied so as to positively feed the yarn, passing the yarn through a weighted dancer that provides a control signal to increase the speed of rotation when the dancer goes up and decrease the speed of rotation when the dancer goes down, pulling the yarn in an unsupported manner upward and forward, and directing air transverse to the yarn being so pulled so as to cause the filaments of the yarn to open up into a flattened ribbon.

In another aspect, the invention features, in general, apparatus for commingling different multiple filament yarns that includes a plurality of sources of one kind of multiple filament yarn and a plurality of tension adjustment devices for each individual yarn to reduce differences in tension among the yarns as they are presented as flattened ribbon and combined with a flattened ribbon of a different type of yarn.

In preferred embodiments, the tension adjustment devices are weights that have yarn guides through which the yarns pass, each guide being mounted for up and down movement along a defined path as the tension in the yarn increases and decreases. Each tension adjustment devices has vertical pins that extend upward and downward from the yarn guide and are received in vertical holes in upper and lower brackets. Heddles are used to provide the yarn guide and vertical pins. The holes in the brackets are located to provide the desired filament spacing and band width for the flattened ribbon.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

STRUCTURE

Figure 1:
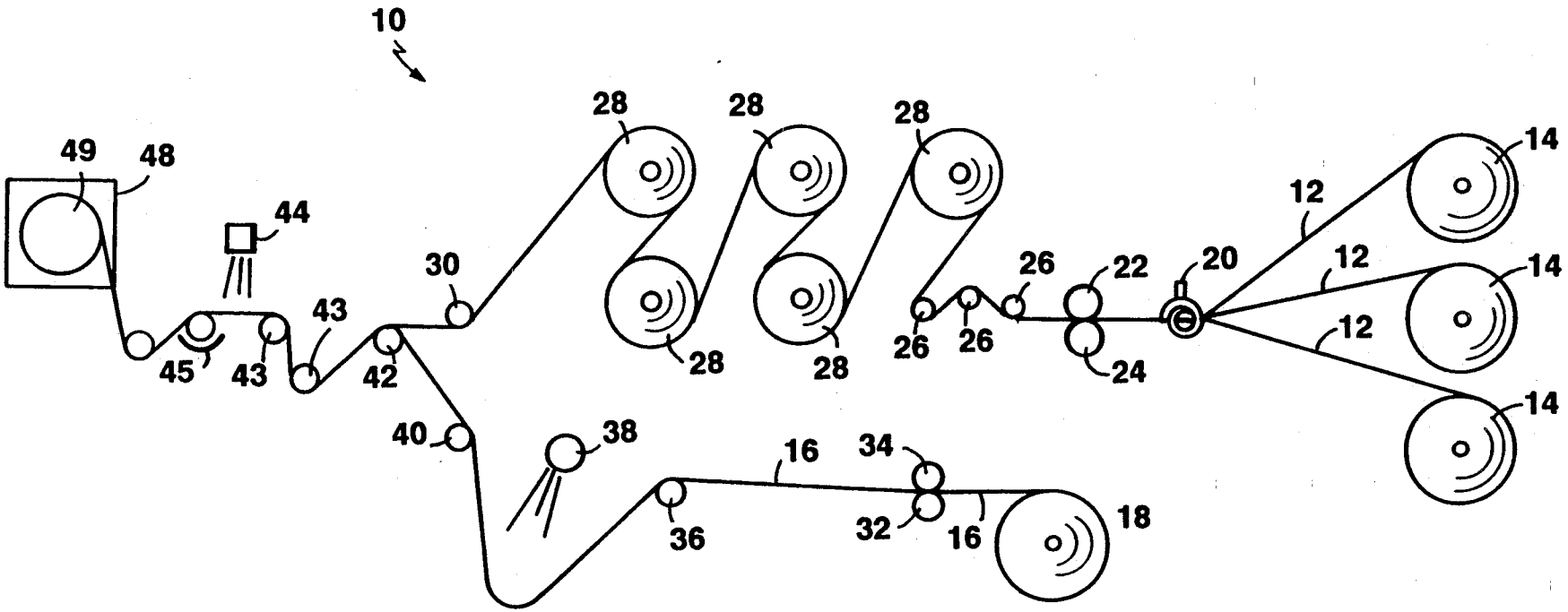
FIG. 1 is a schematic representation of commingling apparatus according to the invention.
Figure 2:
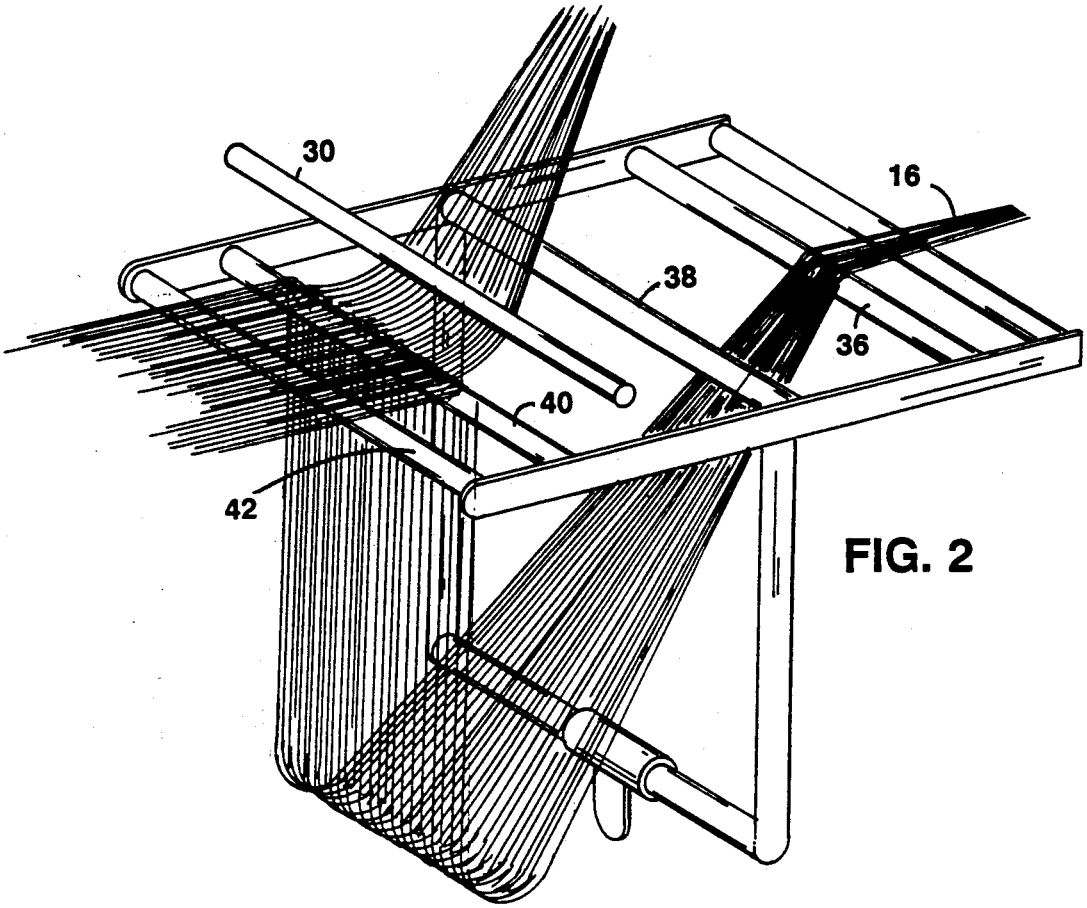
FIG. 2 is a perspective diagrammatic view showing air ribboning and commingling components of the FIG. 1 apparatus.
Figure 3:
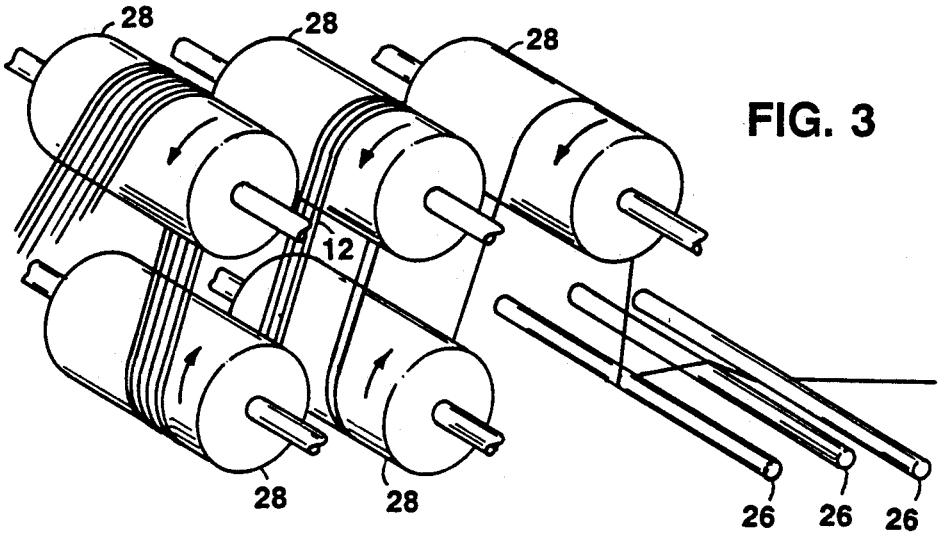
FIG. 3 is a perspective diagrammatic view of rollers of the FIG. 1 apparatus that are used for generating static electricity in a yarn to provide a flat opened ribbon according to the invention.

Referring to FIGS. 1–3, there is shown commingling apparatus 10 in use commingling polyether ether ketone (PEEK) continuous multiple filament yarns 12 from freely rotatable supply rolls 14 and continuous multiple filament graphite yarn 16 from freely rotatable supply roll 18. On the path of travel of PEEK yarn 12, apparatus 10 includes gathering guide 20, motor-driven pinch rollers 22, 24, three pretensioning bars 26, five motor-driven charge-inducing rollers 28 (1/32" thick virgin PTFE Teflon surface layers, available from DuPont, mounted on 4" steel support rollers), and ribboning bar 30. On the path of travel for graphite yarn 16, apparatus 10 includes driven shaft 32, idler shaft 34, support rod 36, air curtain element 38 (a tube connected to a source of pressurized air and having a singe row of downwardly directed holes along its length), and support rod 40. Downstream of support rod 40 and ribboning bar 30 are commingling bar 42, two free-wheeling rollers 43, atomizer 44 (for spraying sizing onto the filaments), and take-up unit 48 (including a traversing mechanism not shown) for wrapping the commingled yarn on take-up roll 49. Rollers 28 are electrically isolated, to permit the static charges to build up on the yarn. Downstream of rollers 28, ribboning bar 30, commingling bar 42, and rollers 43 are grounded, permitting bleeding of the charges.

Pinch rolls 22, 24, driven shaft 32, and take-up unit 48 are driven by a common first drive system (not shown) to achieve the desired velocity of yarn through the apparatus. Rollers 28 are driven by a common second drive system (not shown) that provides variable speed from 0 to 200 feet per minute surface velocity, twice s fast as the typical yarn velocity of 100 feet per minute.

In the example shown in FIG. 1, three multiple filament yarns 12 from three rolls of PEEK (available from Celanese under the trade designation 300/100 SP-301A PEEK) were blended with one continuous filament graphite yarn 16 (3K unsized carbon two available from BASF under the trade designation Celion) to provide the desired proportion of the two.

OPERATION

In operation, in general, the continuous multiple filament PEEK yarns 12 and graphite yarn 16 are separately opened up into flat opened ribbons, the flat opened ribbons are combined so as to have interleaving of different filaments, and the resulting combined flat ribbon is narrowed and wound up on the takeup roll. The graphite and PEEK yarns travel at approximately 100 feet per minute through apparatus 10.

Discussing the processing of PEEK yarns 12 first, the three yarns pass through and are combined at guide 20. From there they are driven between pinch rollers 22, 24 and through pretensioning bars 26 to rollers 28. Pretensioning bars 26 assist providing desired tension in the PEEK yarns as they travel past and around rollers 28. The PEEK yarn cannot be opened up by application of an air curtain and, therefore, is opened up by generating a static charge on it through the use of rollers 28. Rollers 28 are driven at speeds to cause relative travel between the PEEK filaments and the Teflon surface. Rolls 28 develop a charge that is opposite that developed in the PEEK fibers, causing the fibers to be attracted to the rollers, and increasing the tension in fibers 12 as they pass through the five rollers 28. (I.e., the attraction must be overcome in pulling the yarns off of the surfaces of the rollers.) Around 6000 volts is generated in passing through rollers 28, and the electrical charge applied to the yarn filaments causes them to repel each other. Because the cross-sectional configuration of the charged yarn leaving rolls 28 thus tends to be circular, the open filament bundle is drawn under ribboning bar 30 under tension to force the bundle into the shape of a flat opened ribbon. As is seen in FIG. 2, by the time the filaments leave ribboning bar 30, they are in parallel configuration, and the ribbon is approximately two to four inches wide. By varying the tension in the PEEK yarns and the speeds of rollers 28, the charge applied to the PEEK filaments can be adjusted as necessary to provide the desired opening of the individual filaments, and the desired width of the flat ribbon that matches that of the flat ribbon of graphite yarns. From ribboning bar 30, the flat opened ribbon of PEEK yarns passes over commingling bar 42.

Graphite yarn 16 travels from supply roll 18 between driven shaft 32 and idler shaft 34. Driven shaft 32 is driven at a speed equal to that of take-up roll 49 and pinch rolls 22, 24. The speed of driven shaft 32 can be adjusted if necessary to provide the loop between support rod 36 and support rod 40. The graphite yarn can be opened up into an open ribbon by the application of an air curtain, because the graphite fibers are not greatly attracted to each other. The pressurized curtain causes the loop to extend in the direction of air flow and the individual graphite filaments to separate so that the graphite yarn is in a flat opened ribbon state when it joins with the PEEK ribbon at the commingling bar 42.

At commingling bar 42, the opened ribbons of PEEK and graphite are joined together, and the different filaments are interleaved. From commingling bar 42, the combined flat opened ribbon passes under and over free-wheeling rollers 43 and past atomizer 44, at which sizing is sprayed to cause the individual filaments to tend to adhere to each other. By the time the PEEK filaments reach atomizer 44, the charges have been bled sufficiently to permit the fibers to be in close proximity to each other. At atomizer 44, the commingled yarn has about a 1½" width, which is reduced to about ⅛" to ¼" by the guide of take-up unit 48, which wraps the commingled yarn on take-up roll 49.

The commingled yarn can be stored indefinitely and used to produce woven, drapable, reinforced thermoplastic fabric on conventional equipment. In use in fabricating lightweight, reinforced thermoplastic products, heat and pressure is applied, and the PEEK flows around the reinforcing graphite fibers and bonds the graphite fibers together. The homogeneous nature of the commingled yarn provides intimate contact between the individual filaments of the component PEEK and graphite, thereby, providing improved wet out and bonding. The process is superior to other methods of assembling such yarns, for example, twisting and/or parallel winding, because the individual filaments of the component yarns are more homogeneously distributed throughout the resulting yarn. Because the yarn is commingled rather than layered, the component materials are more evenly distributed in the final product, resulting in better blending of reinforcing graphite fibers and resin matrix fibers, thereby producing superior products.

The speed of travel through apparatus 10 has an effect on the quality of the product, in particular its homogeneity. It was found that as the speed was increased from 20 fpm to around 70 fpm there was not much noticeable effect on homogeneity; at around 70 fpm, improvements in quality were first noted, and increasing speed from 70 to over 10 fpm resulted in further improvements in homogeneity. Continuing to increase speed above 100 fpm should improve homogeneity even further. It is believed that the increased speed promotes parallel PEEK filaments during travel to the commingling bar. One factor permitting the high speeds is that there are no mechanical separating elements, e.g., comb teeth, which would limit speed and potentially damage filaments.

OTHER EMBODIMENTS

Other embodiments of the invention are within the scope of the following claims. For example other yarns besides the PEEK and graphite, e.g., polyphenylene sulfide (PPS), can be used and commingled using apparatus 10. Also more or fewer rolls 28 can be used to provide the charge depending on the material, and a plurality of different yarns can be provided at supply rolls 14. Also each of the yarns being commingled could be rubbed against a static charge-inducing body prior to combining them. Also, instead of atomizer 44, sizing roll 45 ( a roller partially located in a trough containing a sizing liquid) could be used to apply sizing to the yarns, and materials other than Teflon can be used in the static charge-inducing body.

Figure 4:
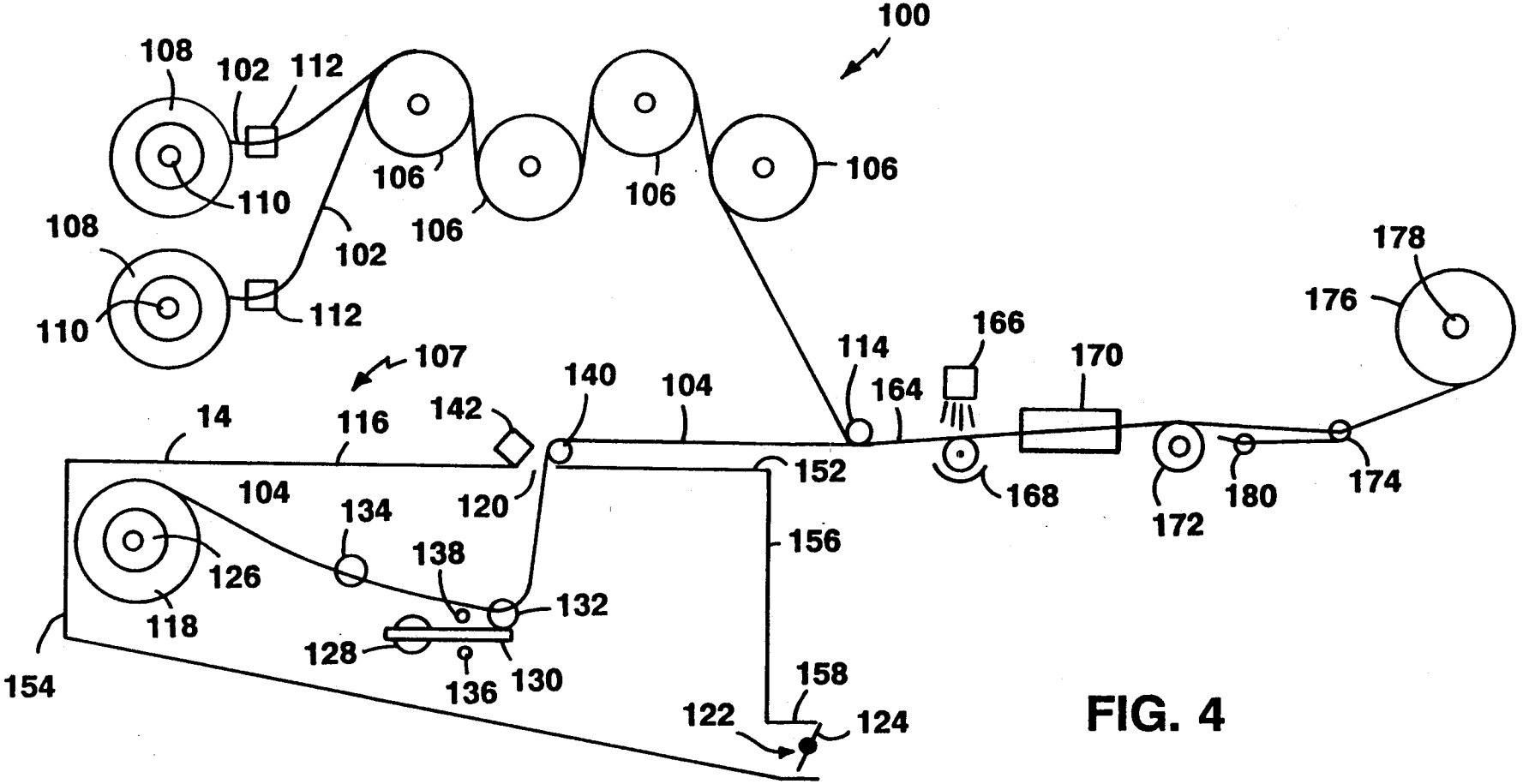
FIG. 4 is a schematic representation of another embodiment of commingling apparatus according to the invention.
Figure 5:
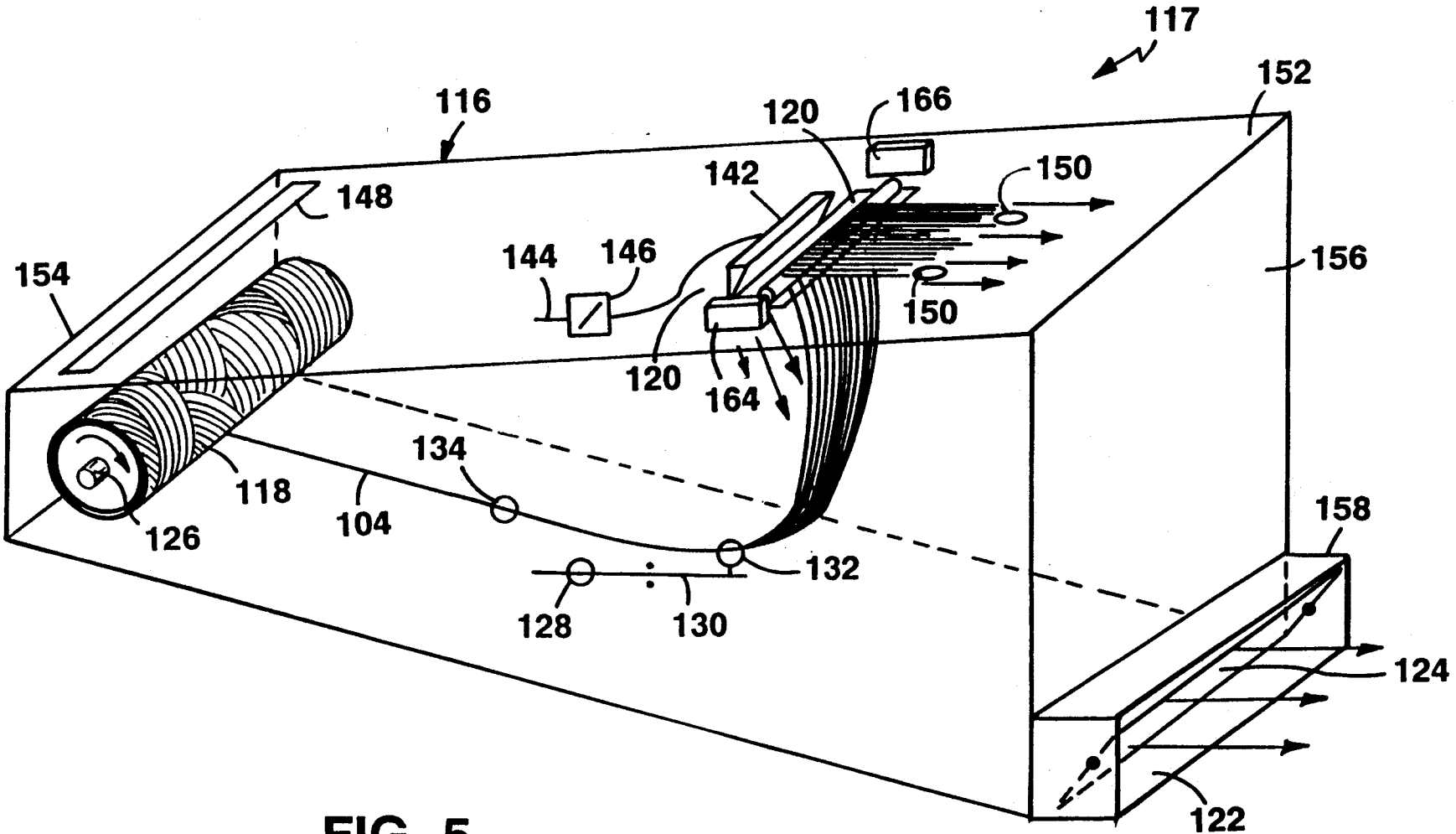
FIG. 5 is a diagrammatic perspective view of an enclosed yarn separating system of the FIG. 4 apparatus.
Figure 6:
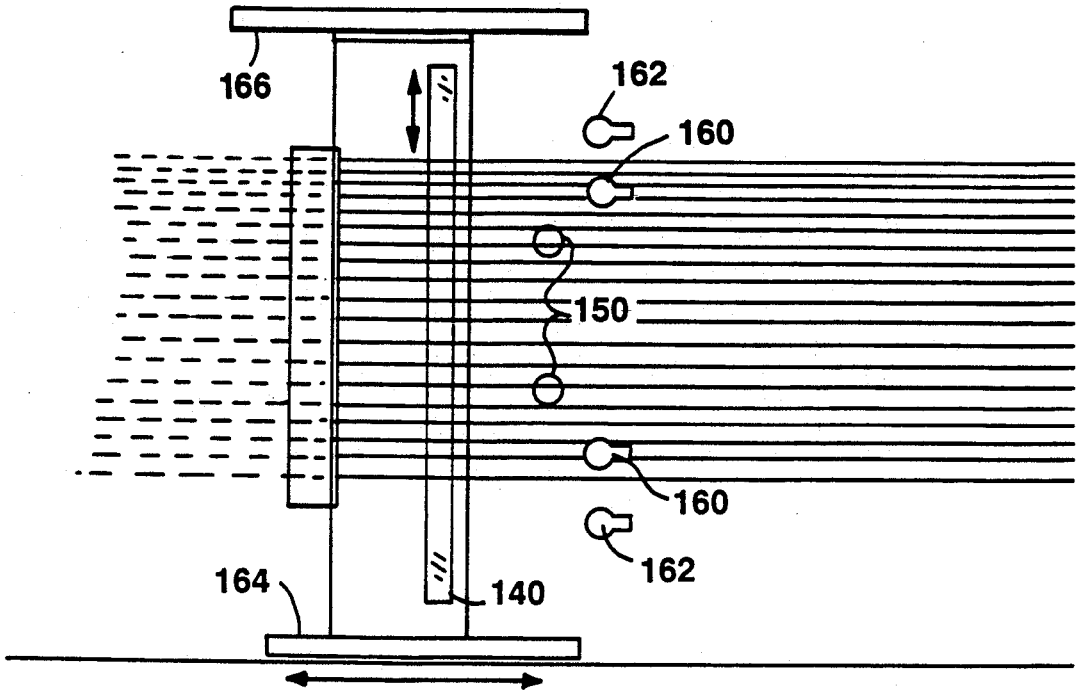
FIG. 6 is a partial plan view of the FIG. 5 system.

Another embodiment of commingling apparatus is shown in FIGS. 4–6. FIG. 4 shows commingling apparatus 100 for commingling thermoplastic yarn 102 and reinforcing yarn 104. Thermoplastic yarn 102 is a continuous multiple filament yarn of material such as PEEK, which can be difficult to separate. Static charge generating rolls 106 are employed to induce charge to help separate the individual filaments. Reinforcing yarn 104 is a continuous multiple filament yarn that carries particles that might be liberated upon separation of the filaments (e.g., some grades of graphite yarn), and enclosed separator 107 is employed to separate filaments of this yarn. Thermoplastic yarn 102 is supplied from supply rolls 108 that are mounted on rotatable driven shafts 110. The drive for shafts 110 is controlled by feedback from remote tension sensors 112 that are set to cause shafts 110 to rotate at a rate so as to maintain a constant tension in yarn 102.

From tension sensors 112, yarn 102 proceeds to static charge generating rolls 106 and then to commingling roller 114. The speed of charge generating rolls 106 is controlled by a closed loop feedback system whereby a signal generated by a toothed gear on the shaft of any roll 106 is picked up by a sensor and fed to the charge generating rolls' drive unit. This unit electronically adjusts the speed of the drive to insure that the charge generating roll speed remains constant regardless of any resistance the rolls encounter.

Enclosed separator 107 has the dual functions of separating filaments of reinforcing yarn 104 and removing any particles liberated during the separation of filaments to prevent such particles from getting into the atmosphere and causing a health hazard in the vicinity of apparatus 100. Plexiglas enclosure 116 completely encloses the source of yarn 104, namely yarn supply roll 118. Enclosure 116 is kept under continuous vacuum by removal of air through air removal opening 122, which has damper 124 therein and is connected to a vacuum source that draws 700 cfm. Yarn supply roll 118 is mounted on rotatably driven shaft 126, which is controlled by control signals based on the output voltage of potentiometer 128, which supports and is actuated by dancer 130. Dancer 130 has guide 132 at its end through which yarn 104 passes. Yarn 104 passes through guide 134 on its travel from roll 118 to guide 132. Dancer 130 is adjusted so that, in the horizontal position, the desired tension exists in yarn 104, and zero voltage is outputted by potentiometer 128. Should increased tension in yarn 104 cause dancer 130 to rise, the output of potentiometer 128 would increase in voltage, causing roll 118 to be rotated and unwind at an increased ate until dancer 130 returns to the horizontal position. Slackening of yarn 104 causes the opposite reaction, i.e., a decrease in speed until dancer 130 is returned to the horizontal position. Limit switches 136, 138 cause apparatus 100 to immediately stop if dancer 130 moves too far from the horizontal position, the lower switch 136 detecting, e.g., a break in or end of yarn 104, the upper switch 138 detecting, e.g., an upstream snag.

From guide 132 on dancer 130, yarn 104 travels forward and upward through yarn exit opening 120, over roller 140 and forward above the upper wall 152 of enclosure 116. The lower pressure at air removal opening 122 with respect to atmospheric pressure at opening 120 causes air to travel from opening 120 to opening 122. The air travels through and around the unsupported "loop" of yarn 104 between guide 132 and roller 140, causing individual filaments to be separated from each other and the yarn to take the shape of a flat opened ribbon. The feed control provided by dancer 130 precisely regulates the tension and shape of loop of yarn 104 between guide 132 and roller 140. Mounted directly behind yarn exit opening 120 is curtain transvector 142 (e.g., available from Vortec), which is connected to a source of compressed air via tube 144 having flow control valve 146 therein. Transvector 142 has a very thin slot that is aimed into opening 120 and is shaped to increase the airflow in the air curtain provided by it to be larger than the flow through its slot. Depending upon the characteristics of yarn 104, transvector 142 may or may not be used to increase the airflow through and around yarn 104.

Enclosure 116 has a slotted opening 148 over yarn supply roll 118 to provide an airflow that removes particles liberated during the unwinding of roll 118 and travel of yarn 104 to dancer 130. Enclosure 116 also has two openings 150 in the upper wall 152 of enclosure 116, just forward of roller 140 and directly under the flat opened ribbon of filaments of yarn traveling forward from roller 140. This causes an airflow through the filaments to capture particles that might have been liberated (or loosened in extent of attachment to filaments) in travel over roller 140. Enclosure 116 increases in cross-sectional area from end 154 near yarn supply roll 118 to end 156 at which air removal opening 122 is located. As can be seen from FIG. 5, air removal opening 122 is provided with transition duct 158 (which is connected to a circular duct that is not shown) and extends along the width of end 156 and is at the bottom of end 156. In addition to causing airflow through yarn 104 in enclosure 116, the shape of enclosure 116 and the positions of the openings in it promote the travel of particles to air removal opening 122 and the avoidance of eddies in enclosure 116, which eddies might otherwise catch particles.

The position of the flattened ribbon (also referred to herein as a "band") on roller 140 and the width of the ribbon or band is sensed by sensors downstream of roller 140 and controlled by adjusting airflow and/or the position of one end of roller 104 with respect to the other end. Referring to FIG. 6, inner left and right sensors 160 determine minimum band width, and outer left and right sensors 162 determine maximum band width.

Band width is a function of the amount of air striking the upper surface of yarn 104 as it approaches opening 120. This air is generated by either compressed air directed through curtain transvector 142, incoming air through opening 120 resulting from the vacuum drawn on opening 122, or a combination of the two. The sensors 160, 162, through a programmable controller, cause either or both valve 146 or damper 124 to restrict or increase the flow of air through transvector 142 or opening 120 as required.

Centering of the band can be accomplished in one of several ways. Again sensors 160, 162 monitor the position of the band. Through feedback to a programmable controller, the sensors indicate the position of the band and any changes necessary to correct it through the use of linear motion devices or stepping motors to move vertical shields 164, 166, roller 140, or transvector 142. Moving one or both of shields 164 and 166 away from opening 120, either linearly in a horizontal plane parallel to the path of yarn 104 or vertically, permits incoming side air to be used to force yarn 104 to the left or right. Roller 140 can be moved to the left or right perpendicular to yarn 104. Alternately, roller 140 can be pivoted at one end while the other end is raised or lowered or moved forward or backward. This would force yarn 104 to the right or left. If in use at the time, transvector 140 can be pivoted, allowing one end to move closer to yarn 104 while the other end moves away from yarn 104. This would move yarn 104 from side to side.

At commingling roller 114, a flattened ribbon of separated thermoplastic filaments of yarn 102 is joined with a flattened ribbon of separated filaments of reinforcing yarn 104 of approximately the same width, and the different filaments are interleaved. From roller 114, the commingled yarn 164 travels past atomizer 166 or sizing roller 168, one of which is used to apply sizing to commingled yarn 164. Yarn 164 then travels past dryer 170, to dry the sizing, and capstan 172, weighted dancer 174 and take-up roller 176, which is rotated by driven shaft 178.

Capstan 172 serves to create the required line speed and to feed commingled yarn 164 to take-up roll 176. The drive for capstan 172 is a closed loop system that enables line speed to remain constant regardless of any tension or mechanical load changes it may experience while running. The drive unit for charge generating roll 106 is switch-selective electrically connected to the drive unit for capstan 172 in a master-slave relationship, with the capstan drive being the master. This allows the operator to individually select the optimum charge generating roll speed in relation to the capstan speed, and then electrically switch the charge generating roll drive to a slave relationship. Thereafter, any change in capstan speed would result in a proportional change in the charge generating roll speed. Weighted dancer 174 provides the desired winding tension by loading dancer 174 with the appropriate weight at the zero position of the associated potentiometer 180. Control signals to the drive unit for driven shaft 178 increase or decrease the rate of rotation (and thus yarn windup) as necessary in order to maintain the position of dancer 174 and thus the desired tension. The accurate winding tension provided by capstan 172, weighted dancer 174, and driven take-up roll 176 reduces damage to the completed, commingled yarn 164.

Figure 7:
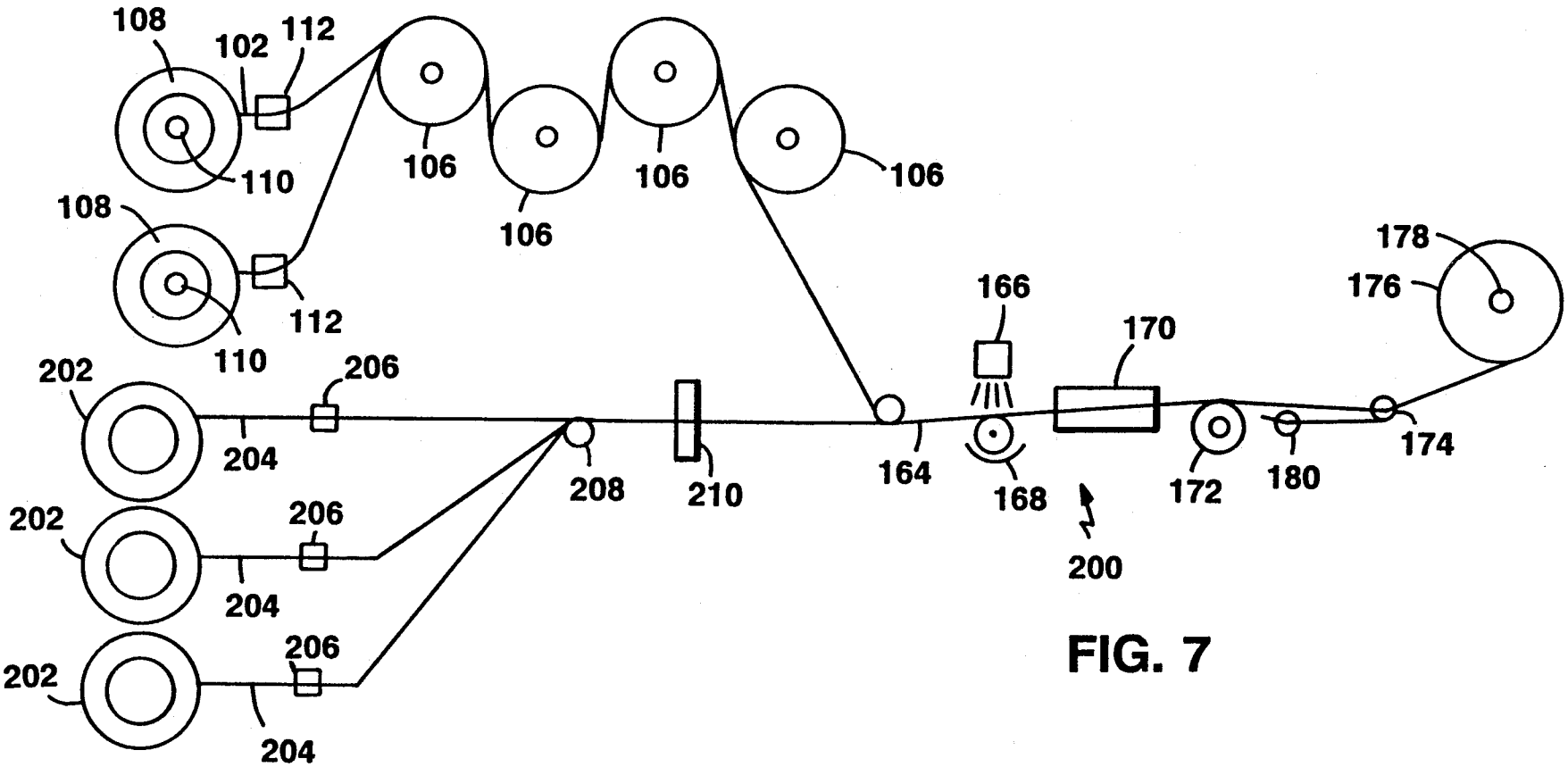
FIG. 7 is a schematic representation of another embodiment of commingling apparatus according to the invention.
Figure 8:
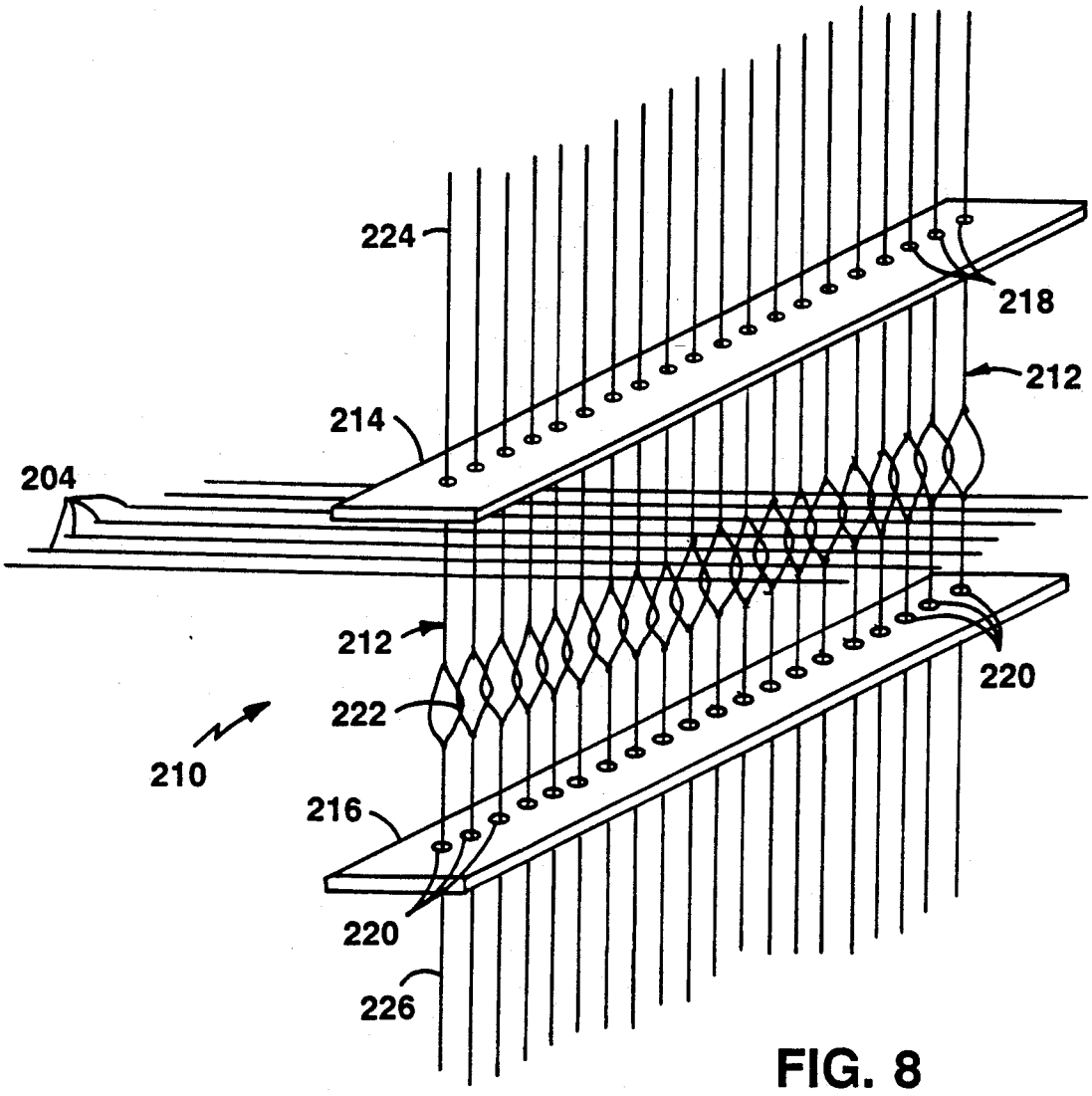
FIG. 8 is a perspective view of a tension adjusting component of the FIG. 7 apparatus.

Another embodiment of commingling apparatus is shown in FIGS. 7 and 8. Commingling apparatus 200 is similar to apparatus 100 in many respects, and the same references numerals are used for components of apparatus 200 that are identical to those in apparatus 100. Apparatus 200 differs from apparatus 100 for using a different filament separator for a different type of reinforcing yarn. The reinforcing yarn that is employed is fiberglass, which might have sizing holding he filaments together. In this case individual filaments of a multiple filament yarn are not opened up; instead a plurality of fiberglass yarns are used, and each yarn is provided with an individual tension adjustment device and is positioned with respect to other yarns to provide a flattened ribbon of such yarns having desired spacing and band width.

A plurality (e.g., nine to eighteen) coreless, wound yarn supply packages 202 are supported in a nonrotatable manner on a support, and yarns 204 are simply pulled from them. Yarns 204 pass through individual tensioning devices 206 and over common horizontal bar 208 to put all yarns in a common horizontal plane. From bar 208, yarns 204 pass through tension compensating assembly 210, which, as shown in FIG. 8, provides an independent tension compensating device 212 for each yarn 204. Assembly 210 includes spaced apart upper and lower brackets 214 and 216 having aligned vertical holes 218, 220 through them. Tensioning devices 212 are made from heddles that are typically used to raise and lower threads during weaving. Each device 212 has central yarn guide 222, upper vertical pin 224 extending upward from guide 222, and lower vertical pin 226 extending downward from guide 222. Upper and lower pins 224, 226 are freely, slidably mounted in holes 218, 220, respectively. The width of a yarn guide 222 along a horizontal axis through both side members defining an opening between them is larger than the center-to-center spacing of holes 218, 220. These horizontal axes of guides 222 orient themselves at angles with an axis between holes 218 or 222 in order to accommodate all of the devices 212. Tensioning devices 212 rise and fall with changes in end-to-end tension of individual yarns 204, promoting uniform tension in the reinforcing yarns 204 in the flattened ribbon at commingling roller 114, and avoiding the catenary effect. Tension compensating assembly 210 also provides uniform spacing between yarns 204 and acts to control the band width.

What is claimed is:

1. Apparatus for commingling two or more continuous multiple filament yarns into a single yarn comprising a first supply means for providing a first multiple filament yarn as a first flattened ribbon at a commingling region, and a second supply means for providing a second multiple filament yarn as a second flattened ribbon at said commingling region, said second supply means comprising an enclosure having a yarn exit opening in an upper surface thereof for passage of said second multiple filament yarn with filaments that are spaced from each other, said enclosure also having an air removal opening located below and to one side of said yarn exit opening, a source of said second multiple filament yarn completely contained within said enclosure, said second multiple filament yarn extending from said source to and through said yarn exit opening, said second multiple filament yarn having a portion between said source and said yarn exit opening that is transverse to the direction of travel of air from said yarn exit opening to said air removal opening, and means for providing a lower pressure at said air removal opening than at said yarn exit opening so as to cause airflow from said yarn exit opening through and around said portion of said yarn to said air removal opening.

2. The apparatus of claim 1 wherein said first supply means comprises a static charge inducing body that is supported in an electrically isolated manner to apply static charge to said second multiple filament yarn as it travels past and rubs against said body to tend to cause separation of individual multiple filaments of said first yarn.

3. The apparatus of claim 2 wherein said body is a variable-speed rotatably-driven roll capable of having a tangential speed that is in the same direction as and is faster than that of said filaments of said first yarn.

4. The apparatus of claim 2 wherein said source is located near one end of said enclosure, said air removal opening is located at another end, and said yarn exit opening is located between said two ends.

5. The apparatus of claim 4 further comprising a tension sensing device mounted in said enclosure, said second yarn passing through said device between said source and said yarn exit opening, said device being connected to control speed of delivery by said source so as to maintain a uniform tension in said second yarn.

* * * * *